US007068137B2

(12) United States Patent
Koenigsberg

(10) Patent No.: US 7,068,137 B2
(45) Date of Patent: Jun. 27, 2006

(54) STRAIN-RELIEVING WIRE LEAD-IN

(75) Inventor: William D. Koenigsberg, Concord, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/807,798

(22) Filed: Mar. 24, 2004

(65) Prior Publication Data

US 2005/0212639 A1 Sep. 29, 2005

(51) Int. Cl.
*H01F 27/29* (2006.01)

(52) U.S. Cl. ..... 336/192; 336/198

(58) Field of Classification Search ..... 336/65, 336/90, 107, 192, 198, 200
See application file for complete search history.

(56) References Cited

U.S. PATENT DOCUMENTS 2,929,132 A * 3/1960 Wohlhieter ..... 29/605
3,928,829 A * 12/1975 Abrams ..... 335/151
4,617,543 A 10/1986 Akachi et al. ..... 336/192
4,636,763 A * 1/1987 Nabstedt et al. ..... 336/192
4,700,167 A * 10/1987 Barankin et al. ..... 336/192
4,760,366 A 7/1988 Mitsui ..... 336/233
4,853,667 A * 8/1989 Freimuth et al. ..... 336/192
5,315,280 A * 5/1994 Stokes et al. ..... 336/192
5,694,105 A * 12/1997 Weiner ..... 336/198
6,369,682 B1 * 4/2002 Thompson et al. ..... 336/192
6,559,749 B1 * 5/2003 Weiner ..... 336/192

* cited by examiner

*Primary Examiner*—Tuyen T Nguyen
(74) *Attorney, Agent, or Firm*—Carlo S. Bessone

(57) ABSTRACT

A coil bobbin (10) that comprises a housing (12) with an interior (13) and including a floor (14) with at least one electrical lead-in (16) projecting through an aperture (15) in the floor. The lead-in (16) has one end (17) formed for attachment to a printed circuit board (18). The electrical lead-in (16) has a given diameter D1 and is provided with thermal-strain relief (20) positioned within the interior (13) of housing (14). The aperture (15) has a diameter D2 larger than the given diameter D1 of the lead-in. The larger diameter D2 of the aperture allows free movement of the lead-in during thermal cycling and contributes to the desired result. This construction also allows the use of round lead-ins over the previously employed square lead-ins, which were required to provide the rigid interference fit previously necessary.

3 Claims, 1 Drawing Sheet

STRAIN-RELIEVING WIRE LEAD-IN

TECHNICAL FIELD

This invention relates to electronic devices and more particularly to such devices that are potted with a material to help transfer heat out, to provide protection from moisture and to attenuate the effects of mechanical shock, etc. One specific, non-limiting example of such a device is a ballast for use with arc discharge lamps.

BACKGROUND ART

Because of internal thermal dissipation, the temperature of an electronic ballast for arc discharge lamps increases when the ballast is turned on and decreases, that is, returns to ambient temperature, when it is turned off. Repetition of this operation in meeting daily lighting requirements is referred to as temperature cycling. Even when not being used to operate a lamp or lamps, the ballast is subject to the rise and fall of the ambient temperature. This can be critical to the reliability of operation in an outdoor environment, especially in colder climates, because of thermomechanically-induced forces impressed upon circuit board solder joints.

Solder joint cracking is often associated with electronic components that are not strain-relieved on ballast circuit boards that are encapsulated in, for example, asphalt-based potting compounds. This occurs because of thermomechanically-induced forces on the circuit board solder joints. This strain is the consequence of two things: temperature cycling of the ballast and the substantial inherent mismatch between the coefficients of expansion of the potting material and the electronic components.

Over the temperature range of expected operation, the thermal expansion coefficient of asphalt is nominally 8 to 10 times greater than that of the copper or solder. When the temperature increases, the encapsulating potting material expands, pushing components away from the circuit board; when the temperature decreases, the potting material shrinks, pulling components toward the board. Ultimately, this thermally induced pushing and pulling fatigues the solder joints, causing mechanical failure and subsequent electrical disconnection within the circuit.

One of the major components exhibiting these types of problems are bobbins about which wire windings are wrapped, such as transformers and inductors used in the aforementioned electronic ballasts. Existing bobbins have lead-ins that serve as rigid connections between the windings and the circuit board. Generally, these lead-ins are either straight or L-shaped.

It would be an advance in the art if simple modifications could be made to these structures to reduce or eliminate the thermally-induced strain problems caused by thermal cycling.

It would be a further advance in the art if these problems could be addressed without adding any additional height to the bobbins.

DISCLOSURE OF INVENTION

It is, therefore, an object of the invention to obviate the disadvantages of the prior art.

It is another object of the invention to reduce or eliminate thermally induced strains in electronic components.

It is yet another object of the invention to reduce or eliminate thermally induced strains in electronic components without adding additional height to the component.

These objects are accomplished, in one aspect of the invention, by the provision of a coil bobbin that comprises a housing having an interior and including a floor with at least one electrical lead-in projecting through an aperture in the floor for attachment to a printed circuit board. The at least one electrical lead-in has a given diameter and is provided with thermal-strain relief that is positioned within the interior of the housing. An end of the lead-in can extend beyond the housing to aid in the attachment of the coil winding. The aperture in the floor of the housing has a diameter larger than the given diameter of the lead-in.

Incorporating the thermal strain relief within the housing does not increase the height or thickness of the bobbin package and still suppresses the thermally-induced strain associated with operation of the electronic component utilizing the bobbin.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
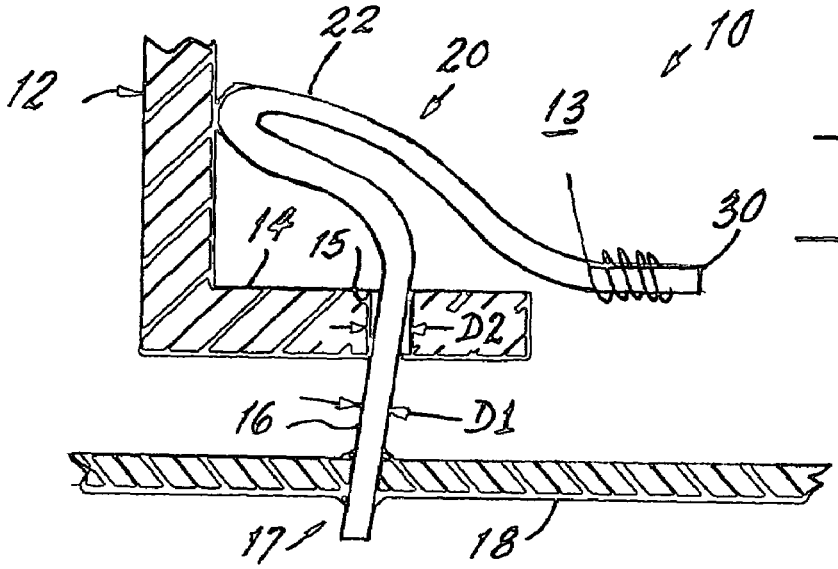
FIG. 1 is a partial, elevational sectional view of an embodiment of the invention.
Figure 2:
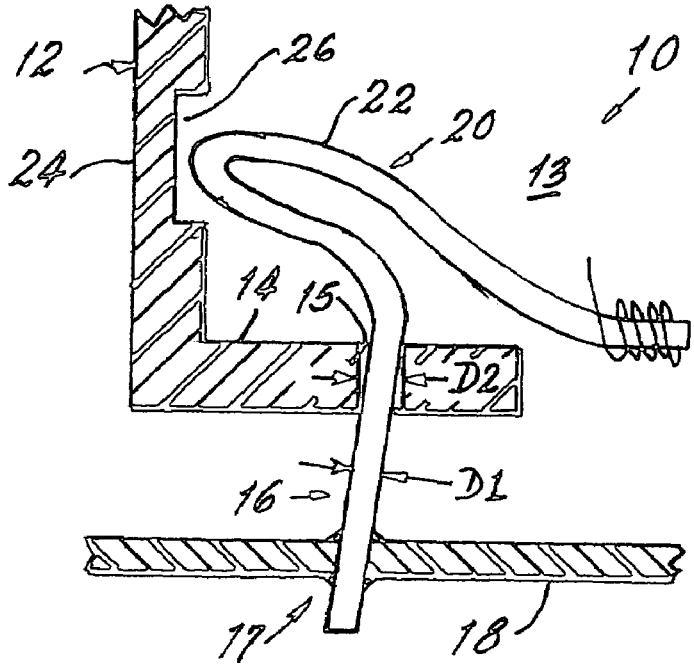
FIG. 2 is a similar view of an alternate embodiment of the invention.

Referring now to the drawings with greater particularity, there is shown in FIG. 1 a coil bobbin 10 that comprises a housing 12 with an interior 13 and including a floor 14 with at least one electrical lead-in 16 projecting through an aperture 15 in the floor. The lead-in 16 has one end 17 formed for attachment to a printed circuit board 18. The electrical lead-in 16 has a given diameter D1 and is provided with thermal-strain relief 20 positioned within the interior 13 of housing 14. The aperture 15 has a diameter D2 larger than the given diameter D1 of the lead-in. The larger diameter of the aperture allows free movement of the lead-in during thermal cycling and contributes to the desired result of realizing strain relief. This construction also allows the use of round lead-ins over the previously employed square lead-ins, which were required to provide the rigid interference fit previously necessary.

The thermal-strain relief 20 in a preferred embodiment of the invention comprises a loop 22 formed in the lead-in 16. Extra length can be provided in the lead-in 16 to accommodate the loop 22.

In still another embodiment of the invention the housing 12 includes a wall 24 adjacent the thermal-strain relief 20 and the wall has a free-play zone 26 therein into which the loop 22 extends. The free-play zone serves as a detent to prevent the lead-in 16 from falling out of the plastic bobbin 10 during handling, insertion and soldering operations. In this configuration the loop 22 is trapped but is still allowed some degree of vertical play that is determined by the shape and extent of the depression formed in wall 24. When the free-play zone is not employed, the lead-in 16 can still be adequately held in place by frictional forces between the sharp bend of the loop 22 and the plastic bobbin material against which it rests. However, the depression or free-play zone is preferred because it can be positioned to precisely delimit the allowed play of the vertical motion.

The lengthening and the particular shaping of the lead-in 16, coupled with the removal of the 'rigid mount' interference fit between the lead-in and the plastic bobbin are directly responsible for the compliance needed to accommodate the thermomechanically-induced forces caused by the heating and cooling of the electronic components and potting compound. Although the expansion and contraction of the asphalt potting material is not diminished, the damage-inducing effect on the solder joints is reduced because a portion of the consequent force is taken up by the bending of the loop 22 of the lead-in 16.

An advantage of this design is that the thermal-strain reducing element is located directly above the rail or floor of the housing 12 and not below it. Consequently, the overall height of the electronic component remains unchanged. The short extension 30 of the lead-in 16 that extends beyond the footprint of the bobbin is common and does not interfere with the adjacent electronic component.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A coil bobbin comprising:

a housing having an interior and including a floor with at least one electrical lead-in projecting through an aperture in said floor for attachment to a printed circuit board, said at least one electrical lead-in having a given diameter and being provided with thermal-strain relief positioned within said interior, said aperture in said floor having a diameter larger than said given diameter.

2. The coil bobbin of claim 1 wherein said thermal-strain relief comprises a loop.

3. The coil bobbin of claim 2 wherein said housing includes a wall adjacent said thermal-strain relief and said wall has a free-play zone therein comprising a detent into which said loop extends.

* * * * *